United States Patent [19]

Grable

[11] Patent Number: 4,585,274

[45] Date of Patent: Apr. 29, 1986

[54] MINERAL AND METAL PARTICLE RECOVERY APPARATUS AND METHOD

[76] Inventor: Donovan B. Grable, #17 Seasons Ct., Madera, Calif. 93637

[21] Appl. No.: 611,897

[22] Filed: May 18, 1984

[51] Int. Cl.[4] ..... E02F 3/88

[52] U.S. Cl. ..... 299/7; 299/8; 299/9; 37/58; 37/62; 37/63; 37/71

[58] Field of Search ..... 299/7, 8, 9, 18, 39, 299/56; 37/62, 63, 65, 67, 71

[56] References Cited

U.S. PATENT DOCUMENTS

| | | | |
|---|---|---|---|
| 2,889,642 | 6/1959 | Stein | 37/71 X |
| 3,855,807 | 12/1974 | Grable | 37/71 X |
| 3,917,326 | 11/1975 | Grable | 299/8 |
| 4,084,334 | 4/1978 | Wolters et al. | 37/67 |

*Primary Examiner*—Stephen J. Novosad

*Assistant Examiner*—Thomas J. Odar

*Attorney, Agent, or Firm*—William W. Haefliger

[57] ABSTRACT

Apparatus for recovering metallic particles from a recovery hole formed in a sub-surface formation containing said particles, comprises (a) a barge, (b) a rotating cutter head supported by the barge for controlled bodily movement at the recovery hole and for cutting the formation adjacent said hole to form cuttings mixed with said particles, (c) hydraulic conduit means supported by the barge to deliver flushing water to the vicinity of the cutter in said recovery hole, thereby to produce a slurry of water, cuttings and metallic particles, and (d) a suction duct supported by the barge, and having an intake located to draw said slurry from the hole for subsequent processing to separate and recover the metallic particles.

9 Claims, 2 Drawing Figures

MINERAL AND METAL PARTICLE RECOVERY APPARATUS AND METHOD

BACKGROUND OF THE INVENTION

This invention relates generally to recovery of metallic particles or heavy minerals, as for example prescious metal, from underground locations (as for example beneath overburden) that are extremely difficult to reach. Examples are metallic particles or heavy minerals trapped in deep cracks and crevices in hard, uneven bed rock beneath boulders and gravel deposits associated with stream beds. Also, heavy particles such as gold and platinum are difficult to remove from cracks and crevices, by suction methods alone, due to their weight.

SUMMARY OF THE INVENTION

It is a major object of the invention to provide apparatus and methods to gain access to such trapped minerals or particles, and to recover same. The invention in particular concerns novel mining techniques referred to herein as "bell hole" mining, enabling recovering of trapped particles such as gold and platinum.

In its basic apparatus aspects, the invention comprises:

(a) a barge or other movable carrier, or base, (b) a rotating cutter head supported by the barge for controlled bodily movement at the recovery hole and for cutting the formation adjacent said hole to form cuttings mixed with said particles, (c) hydraulic conduit means supported by the barge to deliver flushing water to the vicinity of the cutter in said recovery hole, thereby to produce a slurry of water, cuttings, and metallic particles, and (d) a suction duct supported by the barge and having an intake located to draw said slurry from the hole for subsequent processing to separate and recover the metallic particles.

As will appear, a ladder movable laterally in an arc may have one end connected to or carried by the barge, the ladder extending from the barge toward the recovery hole, there being a cutter drive carried by the ladder, and said suction duct carried by the ladder, and including an actuator on the barge and connected with the ladder to displace the ladder relative to the barge. Also a boom may be carried by the barge to support the hydraulic conduit means for its controlled bodily movement relative to the recovery hole (bell hole). Further, at least one backhoe, or equivalent excavator, may have an associated linkage carried by the barge to project therefrom to the vicinity of the recovery hole, and a controllable scoop carried at the outer end of the linkage to scoop out formation material for enlarging said recovery hole. Two pumps may be provided, one to supply pressurized water to the hydraulic conduit means for delivery at the recovery hole, and the other to apply suction to the suction conduit. The barge may be set aground on overburden as by pump removal of water from the vicinity of the recovery hole, and may be re-floated by water supplied to that hole, to enable barge movement, as for example by operation of the backhoe or backhoes digging into the formation and by linkage powered flexing, whereby the recovery hole location may be extended or otherwise altered.

The basic method of the invention involves the following steps:

(a) providing a barge, (b) providing a cutter head and suspending the head from the barge for controlled bodily movement at the hole, and causing the cutter head to cut the formation at the hole thereby to form cuttings mixed with the particles, (c) providing hydraulic conduit means and supporting said means via the barge for controlled bodily movement to deliver flushing water to the vicinity of the cutter in said hole, thereby to produce a slurry of water, cuttings and metallic particles, and (d) providing a suction duct supported from the barge and withdrawing said slurry from the hole by suction and via said duct for subsequent processing to separate and recover the metallic particles.

These and other objects and advantages of the invention, as well as the details of an illustrative embodiment, will be more fully understood from the following specification and drawings, in which:

DRAWING DESCRIPTION

DETAILED DESCRIPTION

Figure 1:
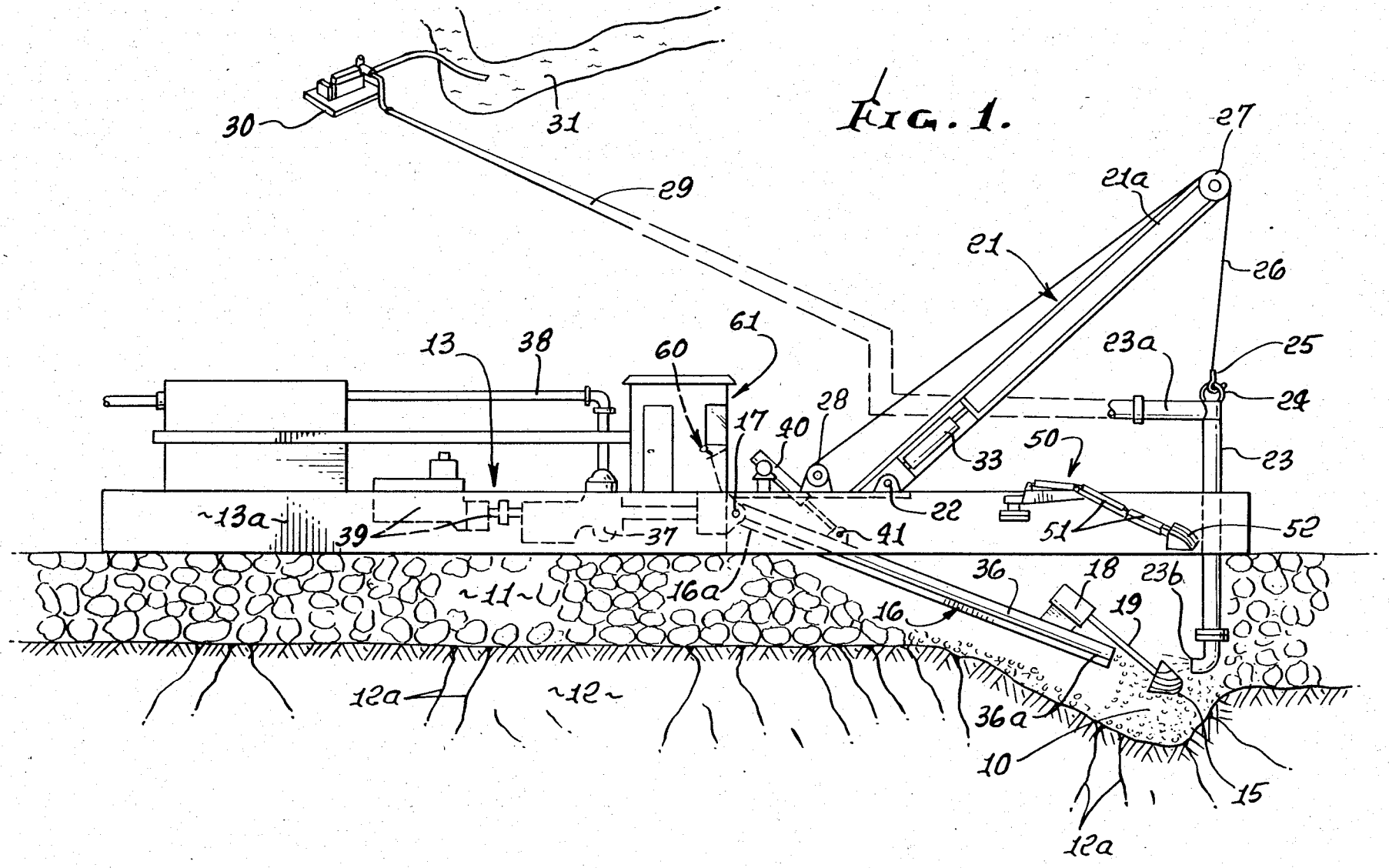
FIG. 1 is an elevation showing operation of the apparatus.
Figure 2:
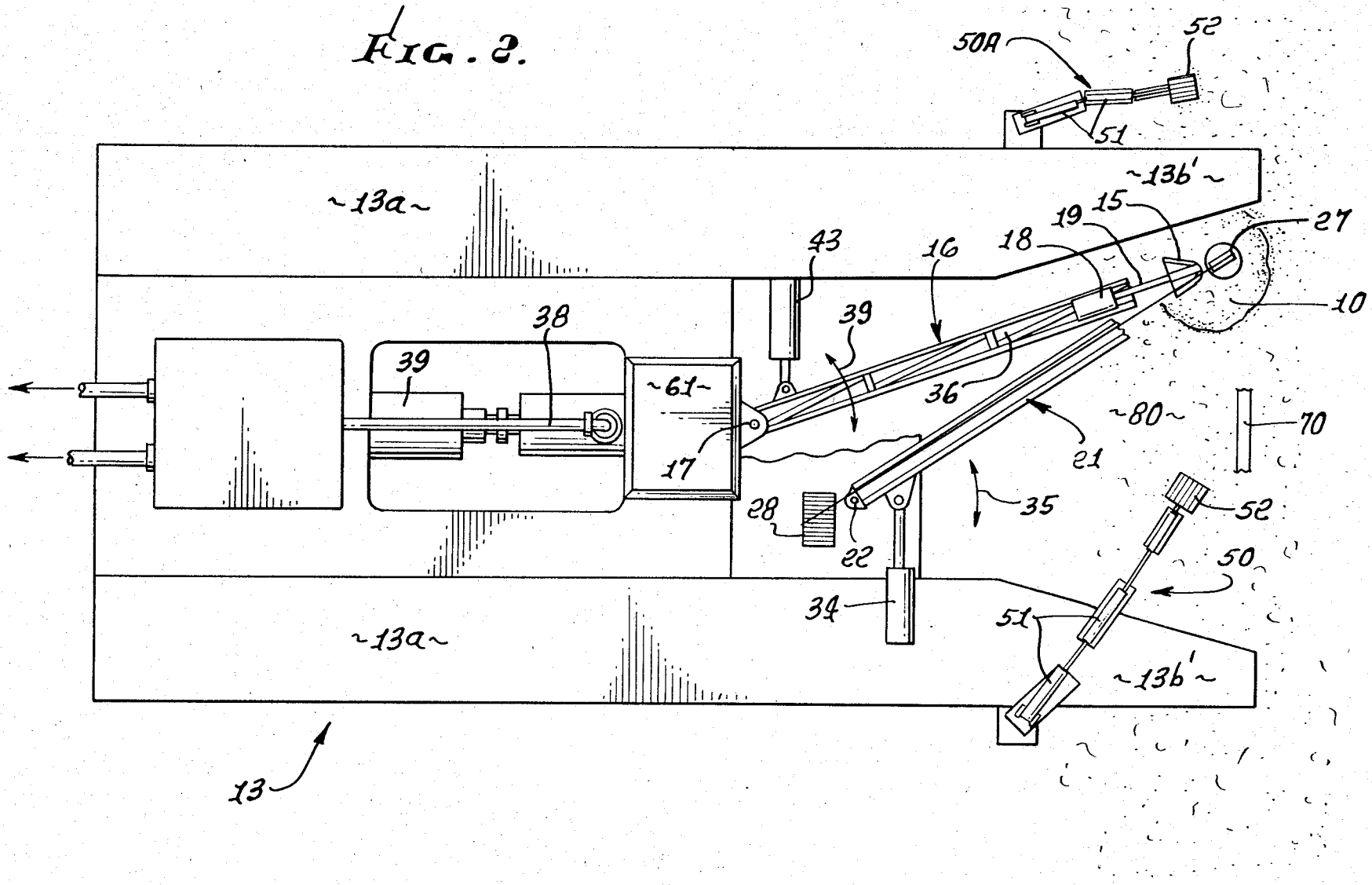
FIG. 2 is a plan view of a portion of the FIG. 1 apparatus.

In FIGS. 1 and 2, apparatus is shown for recovering metallic particles from a recovery (bell) hole 10 formed in a subsurface formation that contains such particles. In the example, the formation is shown to include a layer or stratum 11 of gravel and/or boulders overlying bed rock layer 12, which may typically underlie an active or dry river bed.

In such locations, heavy metallic particles such as gold and platinum (or other prescious metal particles) may collect in cracks and crevices **12*a*** in the bedrock, as well as in the lower regions of the gravel layer, and on the upper surface of the bedrock. It is ordinarily extremely difficult to recover such particles, since their heaviness resists their being entrained by suction methods alone.

The drawings also show the provision of a barge 13 which is or can be floated, so as to be moved about over the gravel and boulder areas. The barge is shown as having its hull **13*a* grounded, or aground, on that layer. A recovery or "bell" hole 10 is formed in accordance with the invention in the layer or layers 11 and 12, and typically extends to a depth below the upper surface of bedrock layer 12** sufficient to encompass the cracks and crevices containing gold and platinum particles.

A rotating cutter head 15 is provided and is typically supported by the barge, as via an elongated ladder type support 16 having one end **16*a* connected to the barge, as for example by a universal pivot or pivots at locations 17**.

A cutter drive motor and reduction gear box 18 is supported on and by the ladder support, to provide reduced speed drive to shaft 19 connected with the cutter head. Accordingly, head 15 is rotated in the recovery hole and at a relatively slow speed (between about 0 and 250 RPM clockwise and counterclockwise) sufficient to cut or loosen the formation at the sides or bottom of (i.e. adjacent to) the recovery hole and also to stir up the cuttings and water in the hole to produce a slurry of cuttings, water and metal particles. To assist this action, hydraulic conduit means is also provided, and is typically supported by the barge (as for example via an A-frame) or boom 21 pivotally connected to the barge at 22. The hydraulic conduit means is shown in the example to include a vertically extending collar 23 as for example a heavy metal tube, suspended as via a ring 24 and hook 25 from a winch line 26. Collar 23 hangs in the open space 80 formed between twin hull extensions 13*b'* of the barge. Line 26 is entrained over a pulley 27 on boom 21, and extends back down to a powered winch 28 on the barge. Water is supplied via a remote line 29 extending to a side inlet 23*a* in the collar. A pump station 30 is shown drawing water from a remote source 31, and supplying water under pressure for delivery by line 29 to collar 23. From the latter, water is delivered at the collar rearwardly facing jet outlet 23*b* to the recovery hole 10, as required to produce the recoverable slurry. Jetting action of the water assists in flushing the metal particles from the bottom of the hole and generally rearwardly into position for suction recovery, violent turbulent flow in the hole being produced. To increase such turbulence, collar 23 is lowered, and vice versa.

Note that hydraulically actuated ram 33 associated with the boom is operable to extend and retract the boom upper member 21*a* that carries pulley 27, to move collar 23 forwardly and rearwardly. Also, an actuator 34 as shown in FIG. 2 is operable to swing the boom laterally, in the direction of arrows 35. Thus, collar 23 is movable in all directions, relative to the barge.

Also provided as a suction conduit 36 supported by the barge, as via the ladder 16, the conduit 36 typically protectively located within the ladder. The suction conduit has an intake 36*a* located at the recovery hole 10 to draw the slurry from the hole for subsequent processing to separate and recover the metallic particles entrained in the slurry. As shown, a second pump 37 on barge 13 has its intake connected with suction conduit 36, and discharges via line 38 to mineral separators. A pump drive is indicated at 39, on the barge.

An actuator 40 on the barge is connected at 41 with the ladder, to raise and lower the latter. The ladder may also have pivotal connection 17 to the barge as described above to enable swinging of the ladder in an arc, i.e. in the direction of arrows 39 in FIG. 2. Actuator 43 on the barge is connected with the ladder to controllably swing same as described.

At least one backhoe 50 may be provided to have an actuator linkage 51 carried by or extending from the barge, and to project to the vicinity of the recovery hole 10. A scoop 52 on the end of the actuator linkage is controllable to scoop out heavy formation material (rocks, etc) for enlarging the recovery hole. The backhoe is also operable to replace material back into the hole after precious metal particles have been removed, thereby to restore the layer 11, as required or otherwise needed. A second such backhoe 50A is also shown in FIG. 2. The backhoe scoops can be operated at front and rear sides of the recovery hole, to progressively move that hole, as desired. The water supply collar can be moved in all directions, horizontally, as well as up and down.

A control console 60 in control house 61 on the barge has finger-tip controls to control all the actuators, winches and pumps to "fine-tune" the system for optimum recovery of minerals and metallic particles in the slurry withdrawn from the recovery (bell) hole.

SPECIFIC EXAMPLE

The procedure for bell hole mining will be the following from a floating barge condition. Both pumps 30 and 37 will start pumping equal amounts of water, the collar 23 to be positioned to wash on and around the cutter head 15. The cutter head can be caused to "walk" in an arc and cover a 30 foot path, 30 inches wide from the center line of the dredge on both sides. A 60 foot sweep can be made from one station. Variable amounts of flushing water can be used during the sweep. By pumping down the mill pond so there is only enough water to float the barge just above layer 11, the water discharged by the collar 23 around the cutter head will be much more effective in flushing minerals out of the crevices. Also, some visual inspection of the bed rock will be possible depending on how fast the water will migrate through the gravel towards the suction inlet 36*a*.

A visual inspection may indicate low places on the bed rock to dig bell holes. One way to develop a bell hole, is to start the backhoes digging and scratching, while moving the cutter head from side to side and while the big volume pump 30 and collar 23 flush the work area. Unless the bed rock is exceptionally hard, a good size cavity can be developed below the surface of the bed rock to serve as a mineral collection pocket or bell hole.

Water pouring through the rocks and gravel will carry heavy minerals toward the lowest point (the bell hole). In one mode, the dredge pump will keep the water pumped down so the dredge or barge will be floating below the water table or partly seated on layer 11 and floating below the water table. This will allow accurate backhoe sampling of the material at or near bed rock.

In some of the more prospective areas for bell hole mining, the water table is about 5 feet below the ground surface and about 15 feet above the bed rock.

After the bell hole has been developed, and the mining or sampling completed, the procedure will be to cover the 50 foot diameter area cleared of overburden by passing the cutter head over the entire area while the collar 23 is washing around the cutter head and the back hoes are digging in front of it. When the entire area has been gone over, then the equipment is returned to the bell hole for a final clean up. Without provision for finger tip control of the mechanical functions of the machinery, bell hole mining would be quite difficult.

The heavy collar 23 may optionally anchor to the barge, as for example to a frame 70 extending between hull extensions 13*b'*. The pump at station 30 may then be operated at high capacity or rate, to cause sufficient rearward jetting from discharge 23*b* as to cause rearward displacement of rocks, and forward advancement of the barge. During mining, the overburden spilling downward into the recovery hole is jet-displaced rearwardly by the jet discharge from outlet 23*b*. Thus, the jet serves to wash away overburden and permit access to the bottom of the hole. Fines and minerals pass through the blades of cutter 15 and are sucked out via the suction line 16, for mineral particles reparation and recovery, as on the barge. Residue is then discharged from the barge.

The invention enables "pump down" below the water table level, so as to enable workers to gain access to the bottom of the recovery hole, for inspecting crevices and cracks in the bedrock. Flow of water table water into the bell hole carries mineral particles and fines into the hole, for suction recovery.

Of importance are the following:

(a) use of the back hoes to dig into ground and bedrock, to loosen it, (b) use of high volumes of water jetted as via pressurized jet 23*b* into the bell hole to displace rocks from the hole, and to optionally advance the barge, (c) use of the rotating cutter to cut the bedrock at the crevice level, to displace lodged mineral particles, for suction recovery.

In certain circumstances, the discharge end of line 29 may be located at location 23*b*, and suitably supported in spaced relation to cutter 15, whereby the collar 23 may be eliminated.

I claim:

1. Apparatus for recovering metallic particles from a recovery hole formed in a sub-surface formation containing said particles comprising (a) a barge, (b) a rotating cutter head supported by the barge for controlled bodily movement at the recovery hole and for cutting the formation adjacent said hole to form cuttings mixed with said particles, (c) hydraulic conduit means supported by the barge to deliver flushing water to the vicinity of the cutter in said recovery hole, thereby to produce a slurry of water, cuttings and metallic particles, (d) a suction duct supported by the barge, and having an intake located to draw said slurry from the hole for subsequent processing to separate and recover the metallic particles, (e) a ladder having one end carried by the barge, the ladder extending from the barge toward the recovery hole, there being a cutter drive carried by the ladder, and said suction duct carried by the ladder, (f) means carried by the barge supporting the ladder to pivot about a generally vertical axis so that the ladder, the suction duct and said intake sweep in an arc, generally horizontally, and an actuator on the barge connected with the ladder to effect said ladder pivoting, (g) and a boom pivotally carried by the barge, the boom supporting said hydraulic conduit means for controlled bodily movement, relative to the recovery hole and relative to the suction intake and cutter head, the conduit means including a generally vertically extending metallic tubular collar, having a discharge outlet to direct water to flow toward the intake, the boom pivotally supported to maintain said outlet near said intake despite ladder pivoting.

2. Apparatus as defined in claim 1 including a winch on the barge and a winch line extending to the boom to support said hydraulic conduit means for controllably lifting and lowering same relative to the recovery hole.

3. The apparatus of claim 1 including at least one backhoe having a linkage carried by the barge to project therefrom to the vicinity of the recovery hole, and a controllable scoop carried at the outer end of the linkage to scoop out formation material for enlarging said recovery hole.

4. The apparatus of claim 3 including a second backhoe having a linkage carried by the barge to project therefrom toward the recovery hole, and a second controllable scoop carried at the outer end of the linkage to scoop out formation material for enlarging said recovery hole.

5. The apparatus of claim 1 including a pump connected with said hydraulic conduit means for supplying a pressurized stream of water for delivery to the recovery hole.

6. The apparatus of claim 1 wherein said recovery hole extends into bedrock, below a gravel and boulder layer, the cutter extending into said hole.

7. The appparatus of claim 6 wherein the barge is aground on said gravel and boulder layer.

8. The apparatus of claim 1 including a suction pump on the barge and connected with said suction duct to draw said slurry from the hole, via said duct.

9. The apparatus of claim 1 including said slurry being drawn from the hole, the particles comprising prescious metal.

* * * * *